US006991313B2

(12) United States Patent
Sasa

(10) Patent No.: US 6,991,313 B2
(45) Date of Patent: Jan. 31, 2006

(54) INK JET PRINTER AND MAIN MAINTENANCE METHOD

(75) Inventor: Masahiko Sasa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 37 days.

(21) Appl. No.: 10/625,773

(22) Filed: Jul. 24, 2003

(65) Prior Publication Data

US 2004/0196326 A1 Oct. 7, 2004

(30) Foreign Application Priority Data

Jul. 26, 2002 (JP) ..... 2002-217548

(51) Int. Cl.
*B41J 2/165* (2006.01)
*B41J 2/175* (2006.01)

(52) U.S. Cl. ..... 347/29; 347/85

(58) Field of Classification Search ..... 347/23, 347/29, 30, 32, 33, 35, 85
See application file for complete search history.

(56) References Cited

U.S. PATENT DOCUMENTS 4,510,510 A 4/1985 Terasawa
4,558,326 A * 12/1985 Kimura et al. ..... 347/30
5,557,306 A * 9/1996 Fukushima et al. ..... 347/33

FOREIGN PATENT DOCUMENTS

| | | | |
|---|---|---|---|
| CN | 1136501 A | | 11/1996 |
| JP | 404070355 A | * | 3/1992 |
| JP | 404080037 A | * | 3/1992 |
| JP | B2 2703647 | | 10/1997 |
| JP | A 10-138506 | | 5/1998 |

* cited by examiner

*Primary Examiner*—Shih-Wen Hsieh
(74) *Attorney, Agent, or Firm*—Oliff & Berridge, PLC

(57) ABSTRACT

In an ink jet printer, a print head having a plurality of nozzles, ink cartridges that accommodate respective inks for printing, and ink supply tubes that connect the respective ink cartridges to the print head are provided. The ink cartridges have ink accommodation chambers and air chambers (on which air pressure is exerted) that are separated from each other by flexible film members, respectively. Also provided are an air pump for producing pressurized air, an air supply tube for guiding the pressurized air produced by the air pump to the air chambers, and an orifice for exhausting part of the pressurized air. The orifice is provided in the vicinity of the air-pump-side end of an air supply tube.

12 Claims, 8 Drawing Sheets

INK JET PRINTER AND MAIN MAINTENANCE METHOD

BACKGROUND OF THE INVENTION

1. Field of the Invention

The present invention relates to an ink jet printer in which maintenance processing is conducted in a state that air pressurized by an air pump is supplied to air chambers of respective ink cartridges.

2. Description of the Related Art

Various ink jet printers have been put in practical use in which color printing is generally conducted on a sheet in such a manner that a print head having a large number of ink jet nozzles that are arranged in columns jet out ink supplied from ink cartridges into ink droplets bit by bit. In those ink jet printers, a maintenance mechanism having a head cap and a cleaning blade, a suction pump, and other members are provided on a main body side thereof. To eliminate air bubbles from ink jet nozzles or to conduct a suction purge at the occurrence of nozzle clogging, the head cap is fitted to the nozzles and the ink in the nozzles is sucked by negative pressure generated by the suction pump. As a result, the air bubbles are removed or the nozzle clogging is solved.

Each ink cartridge is equipped with an ink accommodation chamber and an air chamber for exerting air pressure on the ink in the ink accommodation chamber. In printing or maintaining the ink jet nozzles, a pressure purge is performed in such a manner that pressurized air is introduced from the air pump to each air chamber via an air supply tube and ink that is pushed out of the ink accommodation chamber by the expansion of the air chamber is supplied to the corresponding nozzles.

For example, in an ink jet printer disclosed in Japanese Patent No. 2,703,647, a carriage is equipped with a color print head, a plurality of ink tanks and buffer tanks connected to the head, and other members. A pressurization pump, a waste fluid tank, a maintenance mechanism having a head cap and a cleaning blade, and other members are provided on a main body side. Air pressurized by the pressurization pump is supplied to the ink tanks via a relief valve, thereby pressurizing the ink within the buffer tanks and the ink passages of the head.

In an ink jet recording apparatus disclosed in JP-A-10-138506, a carriage is equipped with a recording head and a subtank unit. Ink cartridges that are connected to the head via supply tubes, an air pump for supplying pressurized air to the ink cartridges, a pressure regulator, a switching valve, etc., are provided on a main body side. When the residual amount of ink in a subtank becomes small, the switching valve switches so that the air pump comes to communicate with ink pouches of the ink cartridges. Air pressurized by the air pump is supplied to the ink pouches via the pressure regulator and the switching valve, and then ink is supplied from the ink pouches to the recording head and the subtank.

In conducting a suction purge, the ink within the nozzles is sucked in a state that the head cap is tightly attached to the nozzles. After completion of the suction purge, since the tightly attached head cap is removed from the nozzles in a state where negative pressure is developed in the head cap, the pressure in the head cap abruptly changes from the negative pressure to the ambient pressure. With that pressure change, the ink that has been sucked so far goes into the nozzles. In this situation, other inks that are stuck to portions around nozzles or air may go into nozzles. This raises a problem that color contamination or loss of a color may occur in the subsequent printing operation.

On the other hand, in the ink jet printer disclosed in Japanese Patent No. 2,703,647 and the ink jet recording apparatus disclosed in JP-A-10-138506, the relief valve or the pressure regulator is provided between the pressurization pump (air pump) and the ink tanks (ink cartridges). The relief valve or the pressure regulator adjusts the pressure of pressurized air that is supplied from the pressurization pump (air pump) to the ink tanks (ink cartridges). Therefore, a space for accommodating the large-size relief valve or pressure regulator is required, thereby leading to problems that the ink jet printer becomes large in size and its manufacturing costs become high.

SUMMARY OF THE INVENTION

The present invention has been made to solve the above problems, and therefore one object of the present invention is to reliably prevent color contamination and loss of a color in printing conducted after purge processing.

Another object of the invention is to conduct, easily at a low cost, a pressure adjustment of pressurized air that is supplied to ink cartridges.

According to an aspect of the invention, there is provided an ink jet printer including: a print head having a plurality of ink jet nozzles arranged in plural columns; an ink cartridge including an ink accommodation chamber having a deformable wall and an air chamber for exerting via the wall air pressure on ink accommodated in the ink accommodation chamber; an ink supply tube connecting the ink cartridge to the print head; an air pump for producing pressurized air for changing a state of ink that is located at a tip portion of each of the ink jet nozzles; an air supply tube for guiding the pressurized air to the air chamber of the ink cartridge; and a maintenance unit including a cap member for covering the print head, wherein the maintenance unit opens the cap member in a state that the pressurized air is supplied to the air chamber of the ink cartridge.

The ink in the ink accommodation chamber, at least part of which is the deformable wall, of the ink cartridge is supplied via the ink supply tube to each of the many ink jet nozzles that are arranged in plural columns in the print head. In maintenance processing, the air pump operates and pressurized air produced by the air pump is introduced into the air chamber of the ink cartridge via the air supply tube. Therefore, the ink accommodation chamber of the ink cartridge receives air pressure.

As a result, the ink in the ink accommodation chamber is supplied to the print head via the ink supply tube, thereby the state of the ink at the tip of each ink jet nozzle is changed, that is, the ink expands there. A purge is performed in this state. When the purge is performed, the print head is covered with the cap member. However, since the cap member is opened in a state that the pressure in the cap member is not a negative one, none of other inks that are stuck to portions around ink jet nozzles, dust, and air go into nozzles. This reliably prevents color contamination or loss of a color that might otherwise occur in the subsequent color printing operation.

BRIEF DESCRIPTION OF THE DRAWINGS

These and other objects and advantages of this invention will become more fully apparent from the following detailed description taken with the accompanying drawings in which:

FIGS. 7A to 7E illustrate how maintenance processing is conducted by supplying pressurized air to ink jet nozzles, in which FIG. 7A illustrates a printing enable state, FIG. 7B illustrates a pressure purge in which a head cap is in operation in a pressurized state, FIG. 7C illustrates a starting state of wiping with a blade in the pressurized state, FIG. 7D illustrates a completion state of the wiping with the blade, and FIG. 7E illustrates a maintenance completion state.

DETAILED DESCRIPTION OF THE PREFERRED EMBODIMENTS

An embodiment of the present invention will be hereinafter described with reference to the accompanying drawings.

This embodiment is such that the invention is applied to a multifunctional apparatus having a telephone function etc. in addition to a printer function, copier function, a scanner function, and a facsimile function.

Figure 1:
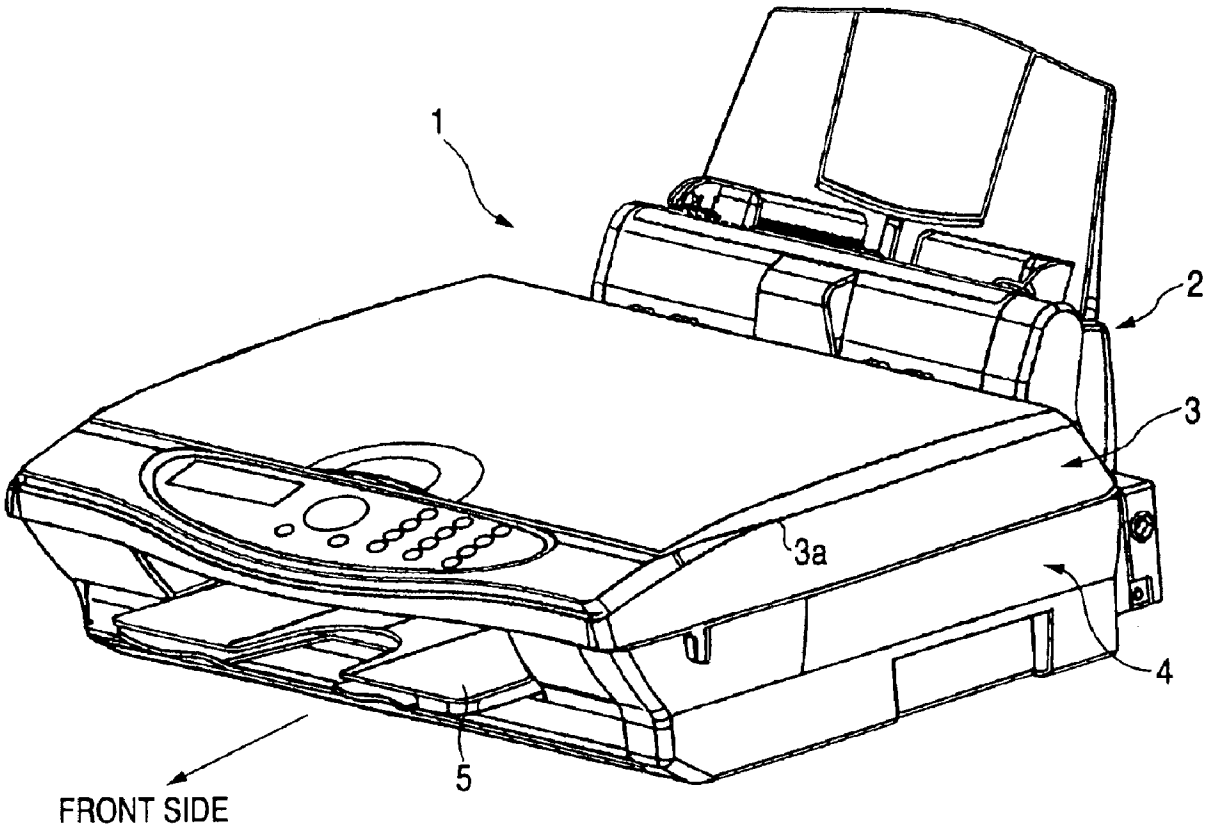
FIG. 1 is a perspective view showing a multifunctional apparatus according to an embodiment of the present invention.

As shown in FIG. 1, a multifunctional apparatus 1 is equipped with a sheet feeder 2 on a back side thereof. A document reading device 3 for the copier function and the facsimile function is disposed so as to occupy a top portion of a section in front of the sheet feeder 2. An ink jet printer 4 as an implementation of the printer function is disposed so as to occupy the entire portion under the document reading device 3. A table 5 for ejection of printed sheets is disposed in front of the ink jet printer 4.

The document reading device 3 is structured as follows (not shown in FIG. 1). The document reading device 3 can be swung vertically around a horizontal axis that is located at the rear end. If a top cover 3*a* is opened upward, a user can see a document placement glass plate. An image scanning device for document reading is disposed under the glass plate. By opening the document reading device 3 upward by hand, the user can replace ink cartridges 40–43 of the ink jet printer 4 or maintain a print mechanism section 10. That is, the ink jet printer 4 is disposed in front of the sheet feeder 2 in a manner as shown in FIG. 2.

Subsequently, the ink jet printer 4 will be described with reference to FIGS. 2–5.

The ink jet printer 4 includes the print mechanism section 10 for printing on a sheet (e.g., A4-sheet) supplied from the sheet feeder 2 by jetting ink droplets from a print head 23P, a maintenance mechanism section 11 for performing maintenance processing on the print head 23P, an ink supply section 12 for supplying inks from the ink cartridges 40–43 to the print mechanism section 10, an air supply section 13 for supplying pressurized air to the ink cartridges 40–43, and other sections. First, the print mechanism section 10 will be described.

Figure 2:
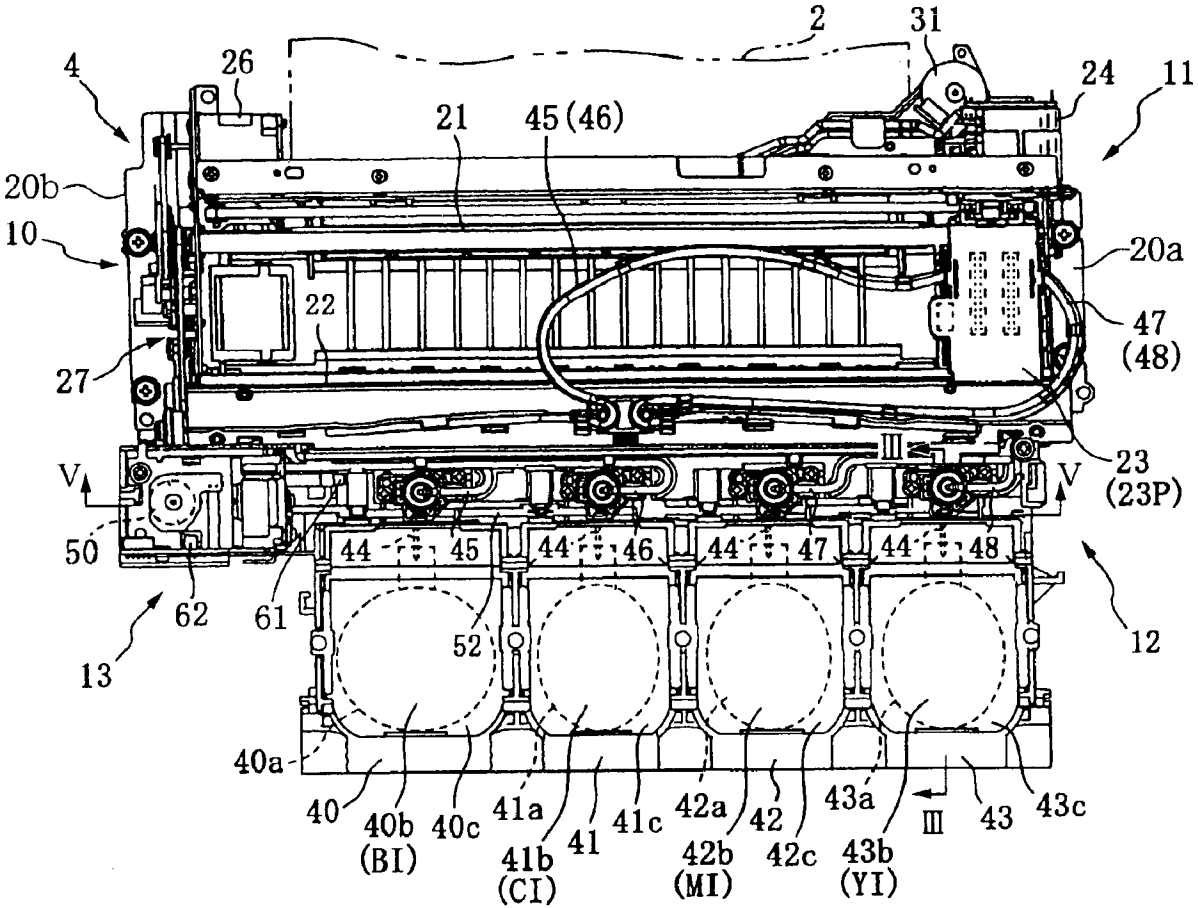
FIG. 2 is a plan view showing internal mechanisms of an ink jet printer.
Figure 4:
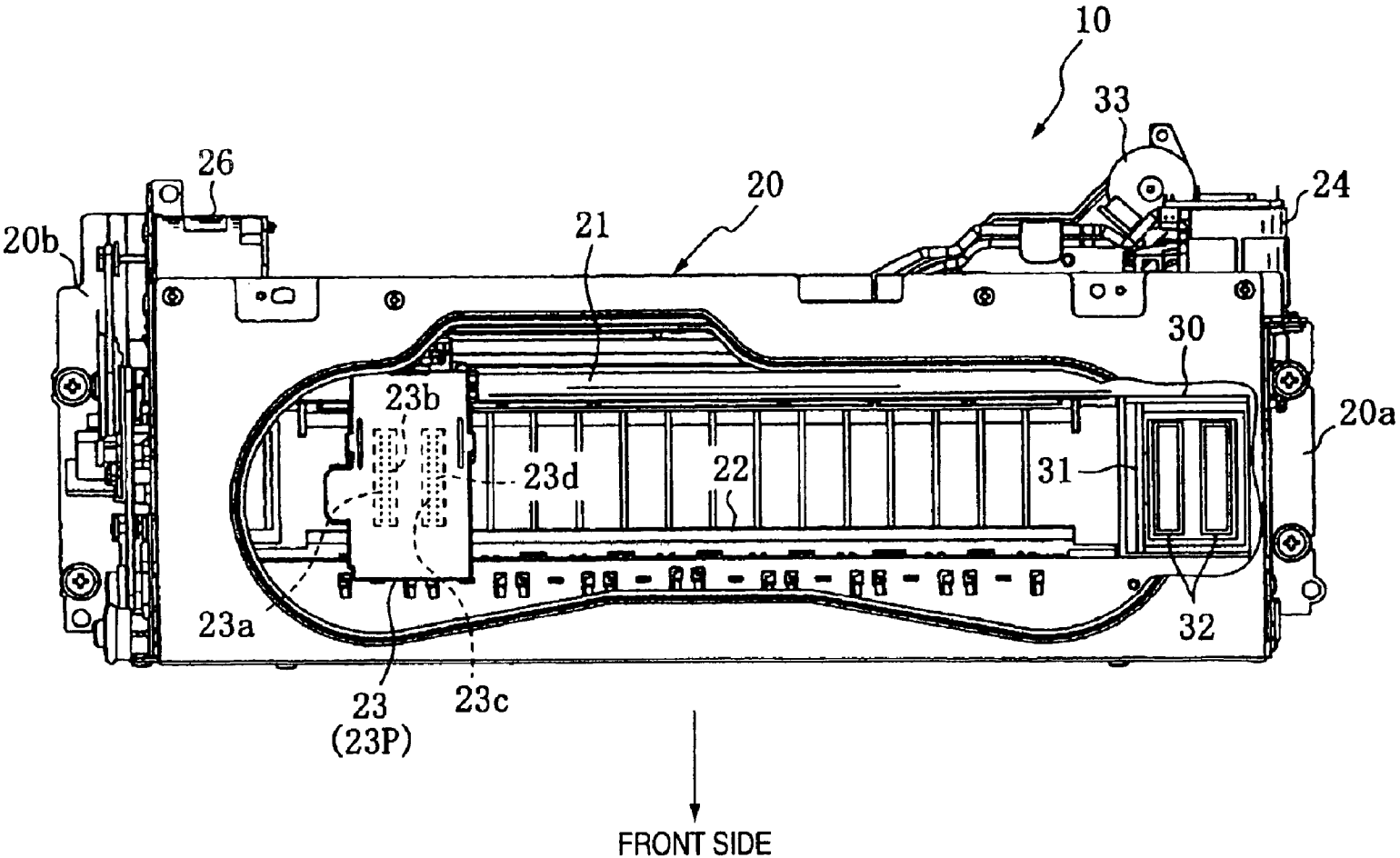
FIG. 4 is a plan view showing the print mechanism section.

As shown in FIGS. 2 and 4, the print mechanism section 10 is housed compactly in a box-shaped print unit frame 20 whose top plate has a generally elliptical opening. The right ends and the left ends of a rear guide shaft 21 and a front guide rail 22 that are provided in the print unit frame 20 so as to extend in the right-left direction are fixed to a right side wall 20*a* and a left side wall 20*b*, respectively. A carriage 23 is supported by the guide shaft 21 and the guide rail 22, and can be reciprocated in the right-left direction along the guide shaft 21 and the guide rail 22 by a carriage driving motor 24 (directed to a front side) via a wire (not shown). The carriage 23 itself also serves as the print head 23P.

As shown in FIGS. 2 and 4, a number of ink jet nozzles (hereinafter referred to as "nozzles") 23*a*–23*d* are arranged on the bottom surface of the print head 23P in four columns so as to correspond to four ink colors (the columns extend in the front-rear direction). The nozzle columns 23*a*–23*d* for black, cyan, magenta, and yellow, respectively, are arranged in the stated order from the left side in such a manner that the black nozzle column 23*a* and the cyan nozzle column 23*b* are disposed close to each other and the magenta nozzle column 23*c* and the yellow nozzle column 23*d* are disposed close to each other. The nozzles 23*a*–23*d* are provided with respective piezoelectric elements (not shown), and very small amounts of ink are jetted from the nozzles 23*a*–23*d* having the piezoelectric element energized toward a sheet.

A main transport roller 25 called "registration roller" is disposed under the guide shaft 21 and rotatably supported by the right side wall 20*a* and the left side wall 20*b*. The main transport roller rotates in a prescribed direction by a sheet feed motor 26 via a gear mechanism 27 to transport a sheet that is supplied from the sheet feeder 2 toward the front side (i.e., in a sheet feed direction) while moving the sheet approximately horizontally right under the print head 23P, and to eject the sheet to the ejection table 5.

Subsequently, the maintenance mechanism section 11 will be described briefly, which is the same as used in ordinary ink jet printers.

As shown in FIG. 4, a thin-plate-shaped wiper blade 31 (corresponds to a wiper member) is disposed vertically in a maintenance case 30 that occupies a right end portion of the print unit frame 20. A pair of rubber head caps 32 (corresponds to a cap member) are disposed upward on the right of the wiper blade 31. When a maintenance motor 33 that is attached to the rear wall of the maintenance case 30 rotates in a normal direction, the wiper blade is moved upward and downward via a blade elevation mechanism (not shown). When the maintenance motor 33 rotates in a reverse direction, the head caps 32 are moved upward and downward via a cap elevation mechanism (not shown).

Subsequently, the ink supply section 12 will be described.

Figure 3:
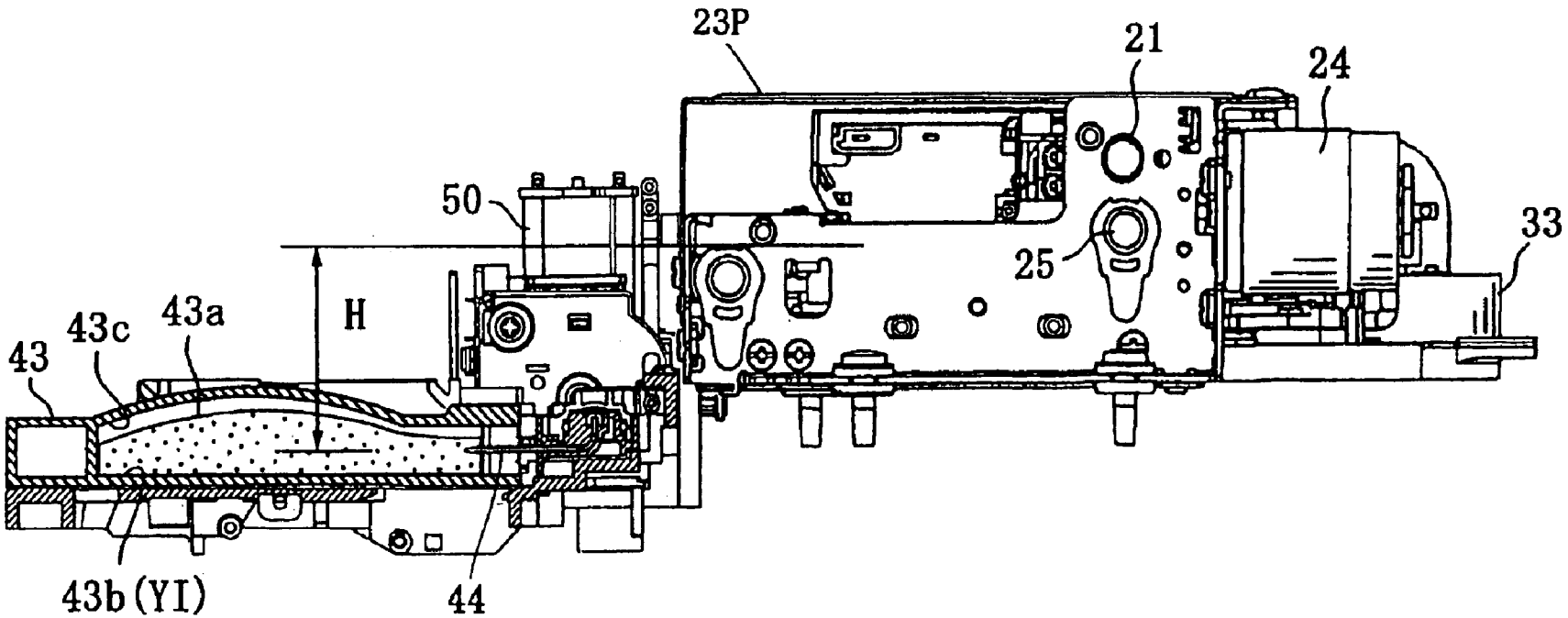
FIG. 3 is a side view of a print mechanism section and a vertical side sectional view taken along line III—III in FIG. 2.

In front of the ink supply section 12, a black ink cartridge 40, a cyan ink cartridge 41, a magenta ink cartridge 42, and a yellow ink cartridge 43 are arranged in the stated order from the left side so as to be at the same height and parallel with each other, so that the ink cartridges 40–43 are accommodated in a small space. As shown in FIG. 3, a flexible film member 43*a* (corresponds to a deformable wall), which is stretched inside the cartridge case of the yellow ink cartridge 43 so as to cover most of its entire area, partitions the cartridge case into a bottom ink accommodation chamber 43*b* and a top air chamber 43*c*.

A yellow ink YI is accommodated in the ink accommodation chamber 43*b*, and the air chamber 43*c* communicates with the ambient air. The other three ink cartridges 40–42 are configured in the same manner as the ink cartridge 43. That is, flexible film members 40*a*–42*a* partition the cartridge cases into bottom ink accommodation chambers 40*b*–42*b* and top air chambers 40*c*–42*c*, respectively. A black ink BI, a cyan ink CI, and a magenta ink MI are accommodated in the ink accommodation chambers 40*b*–42*b* of the black ink cartridge 40, the cyan ink cartridge 41, and the magenta ink cartridge 42, respectively.

Figure 5:
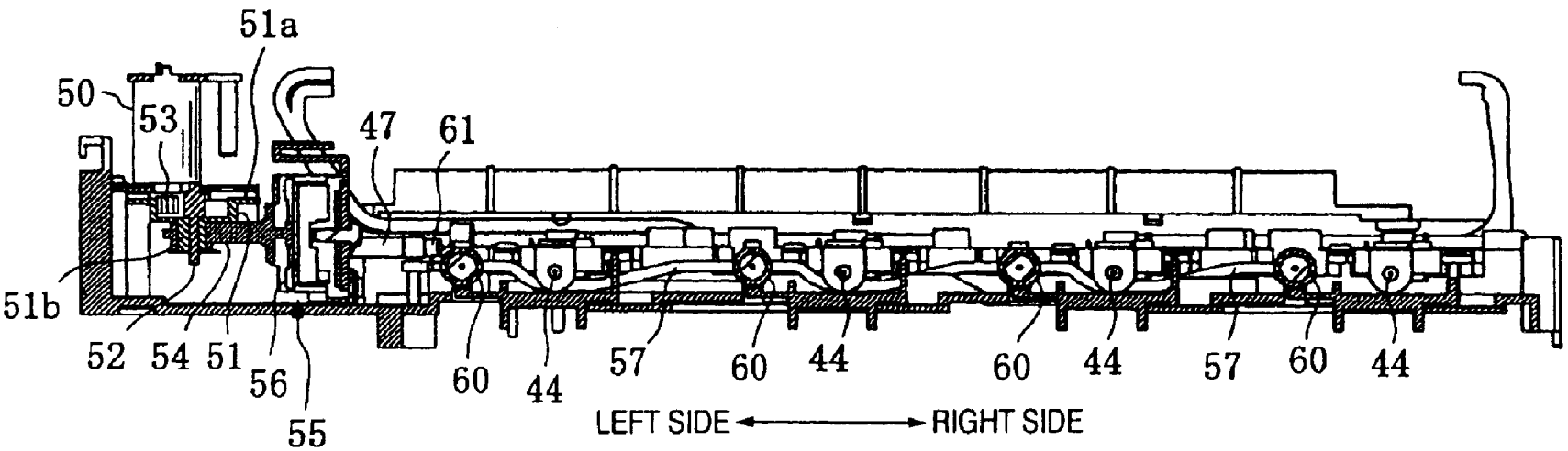
FIG. 5 is a vertical front sectional view taken along line V—V in FIG. 2.

As shown in FIGS. 2, 3 and 5, ink needles 44 are disposed in the rear of the respective ink cartridges 40–43 so as to project toward the front side. The proximal portions of the ink needles 44 are connected to the print head 23P via dedicated ink supply tubes 45–48, respectively. Portions closer to the print head 23P of the black and cyan ink supply tubes 45 and 46 are bundled so as to be arranged in the vertical direction, and portions closer to the print head 23P of the magenta and yellow ink supply tubes 47 and 48 are also bundled so as to be arranged vertically.

As shown in FIG. 3, the print head 23P is positioned higher than the ink cartridges 40–43 so as to generate a head difference H, which is a difference between the heights of the ink needles 44 and the nozzles 23*a*–23*d* of the print head 23P. When the ink cartridges 40–43 are mounted at their prescribed mounting positions, the tip portions of the ink needles 44 penetrate through the rear end portions of the film members 40*a*–43*a* and reach the ink accommodation chambers 40*b*–43*b*, respectively, whereby the inks BI, CI, MI, and YI in the ink accommodation chambers 40*b*–43*b* are supplied to the print head 23P via the dedicated ink supply tubes 45–48, respectively.

Figure 7A:
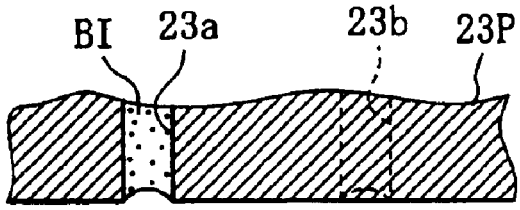

Therefore, the nozzles 23*a*–23*d* of the print head 23P are filled with inks BI, CI, MI, and YI thus supplied and a negative pressure corresponding to the head difference H develops there, whereby meniscuses suitable for printing are formed at the tips of the nozzles 23*a*–23*d* so as to be curved inward as shown in FIG. 7A. FIGS. 7A to 7E show a black nozzle 23*a* and a cyan nozzle 23*b* that is adjacent to the black nozzle 23*a*.

Now, the air supply section 13 will be described.

As shown in FIGS. 2 and 5, a pump motor 50 is disposed on the left of the mounting portion for the black ink cartridge 40 so as to be directed downward. Under the pump motor 50, a cylindrical gear member 51 having a bottom wall is rotatably supported by a support shaft 52. The inside surface of the cylindrical portion of the cylindrical gear member 51 is formed with a gear. A drive gear 53 that is fixed to a drive shaft of the pump motor 50 meshes with the gear of the cylindrical gear member 51 from inside. A top portion of the cylindrical gear member 51 is integrally formed with a plate-like brim 51*a* that has a slit and extends outward from the periphery of the top portion of the cylindrical gear member 51. A bottom portion of the cylindrical gear member 51 is integrally formed with a cylindrical eccentric cam 51*b*.

Figure 6:
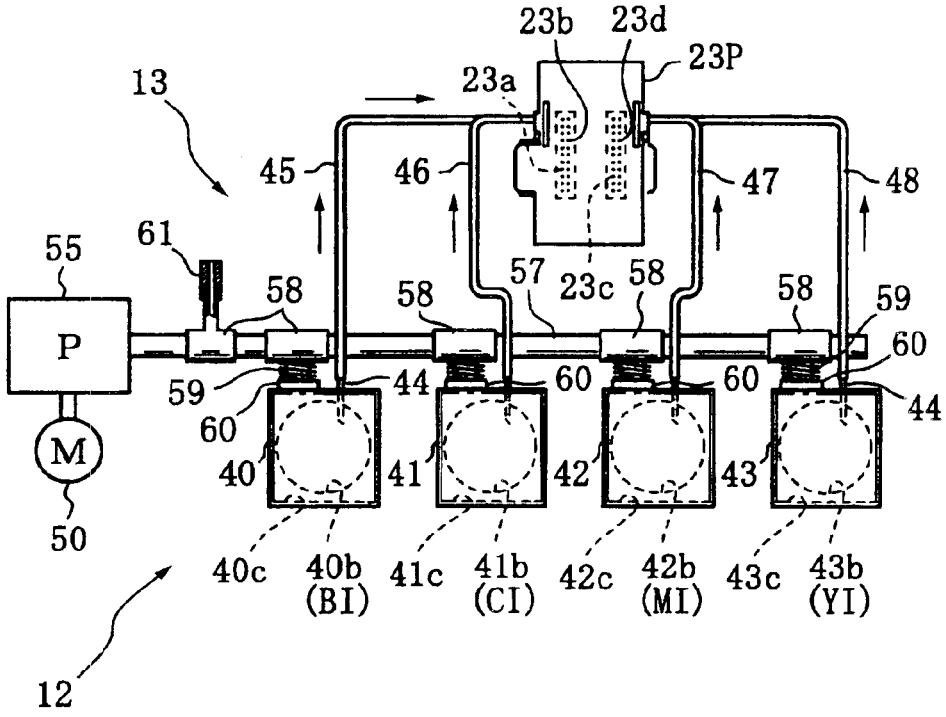
FIG. 6 illustrates an ink supply section and an air supply section.

A left end portion of a connecting rod 54 is slidably fitted with the eccentric cam 51*b* of the cylindrical gear member 51, and a right end portion of the connecting rod 54 is connected to a diaphragm 56 that is provided inside an air pump 55. The air pump 55 is equipped with an exhaust valve and an inlet valve (both not shown), and a left end portion of a flexible air supply tube 57 is connected to the air pump 55. Four T-shaped branching members 58 are attached to the air supply tube 57 at positions that are separated from each other by approximately the same, prescribed length. As shown in FIG. 6, a pressure contact pad 60 that is elastically urged by a coil spring 59 is attached to a branch end portion of each branching member 58

An orifice 61 is fixed to the air supply tube 57 at a position close to its air pump 55 side end via a branching member 58. The inner diameter of the air supply tube 57 is about 1 mm. The orifice 61 has a passage whose inner diameter (e.g., about 0.5 mm) is smaller than the inner diameter of the air supply tube 57. The passage of the orifice 61 always communicates with the ambient air. Therefore, when the ink cartridges 40–43 are mounted at their respective mounting positions, pressurized air is supplied to the air chambers 40*c*–43*c* of the ink cartridges 40–43 via the air supply tube 57 and the pressure contact pads 60 that are urged elastically, respectively.

When the air pump 55 is not in operation, atmospheric pressure acts on the air chambers 40*c*–43*c* via the air supply tube 57 and the pressure contact pads 60. When the pump motor 50 is driven during maintenance processing, the diaphragm 56 is reciprocated in the right-left direction via the drive gear 53, the cylindrical gear member 51, and the eccentric cam 51*b*. The air pump 55 thus operates to produce pressurized air having an increased pressure of about 100 mmAq, which acts on the air chambers 40*c*–43*c*. The pressure of this pressurized air exceeds the negative pressure of the head difference H.

In the situation, the orifice 61 performs a pressure adjustment by exhausting part of the pressurized air produced by the air pump 55. The pressure-adjusted pressurized air acts on the air chambers 40*c*–43*c* with the same air pressure. The top portion of the cylindrical gear member 51 is integrally formed with the plate-like brim 51*a* that has a slit and extends outward from the periphery of the top portion of the cylindrical gear member 51. An encoder 62 that is a photointerrupter is provided to detect the brim 51*a*. The air pump 55 is reciprocated once every time the pump motor 50 makes four rotations, and one detection pulse signal is output from the encoder 62 every time the air pump 55 reciprocates once.

Subsequently, the operation and advantages of the ink jet printer 4 thus configured will be described. When the four ink cartridges 40–43 are mounted at their prescribed mounting positions shown in FIG. 2, the tip portions of the ink needles 44 penetrate through the rear end portions of the film members 40*a*–43*a* and reach the ink accommodation chambers 40*b*–43*b*, respectively, whereby the inks BI, CI, MI, and YI in the ink accommodation chambers 40*b*–43*b* are supplied to the print head 23P via the dedicated ink supply tubes 45–48, respectively, and fill the nozzles 23*a*–23*d* of the print head 23P.

Figure 7B:
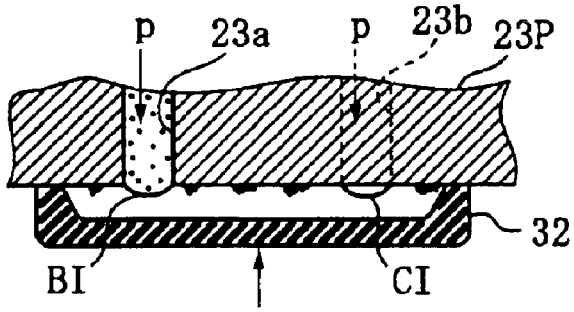
Figure 7C:
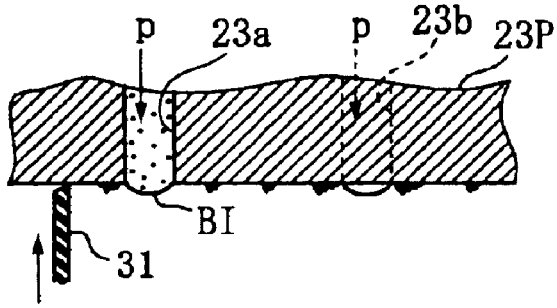

At this time, as shown in FIG. 7A, a negative pressure corresponding to the head difference H develops, whereby meniscuses suitable for printing are formed at the tips of the nozzles 23*a*–23*d* so as to be curved inward. Only a black nozzle 23*a* and a cyan nozzle 23*b* are shown in FIGS. 7A to 7E. As shown in FIGS. 7B and 7C, inks of other colors, dust, etc. are stuck to a surface of the print head 23P in the vicinity of the nozzles 23*a* and 23*b*.

To conduct purge processing before a start of printing, the print head 23P is moved to a maintenance position shown in FIG. 2 and the print head 23P is then capped tightly as shown in FIG. 7B by elevating the head cap 32 to its operating position by rotating the maintenance motor 33 in the reverse direction. The pump motor 50 is then driven in this state.

As a result, the air pump 55 operates in the above-described manner, whereby pressurized air having an air pressure p (about 100 mmAq) is supplied from the air pump 55 to the air chambers 40*c*–43*c* of the respective ink cartridges 40–43 via the air supply tube 57. After a lapse of a prescribed period of time (e.g., about 5 seconds), all the air chambers 40*c*–43*c* are pressurized sufficiently by the pressurized air having the air pressure p to establish a state (i.e., a pressure purge processing completion state) that the inks BI, CI, MI, and YI assume convex shapes at the tips of the nozzles 23*a*–23*d*.

At this time, as described above, part of the pressurized air produced by the air pump 55 is exhausted by the orifice 61, so as to adjust the pressure of the pressurized air. When the pressure purge processing has completed in the above-described manner, the pressure in the head cap 32 is not negative. After a lapse of a prescribed period of time, the maintenance motor 33 is rotated in the normal direction, whereby the head cap 32 that has so far been attached tightly to the print head 23P is removed and the wiper blade 31 is elevated to its operating position as shown in FIG. 7C.

At this time, the inside of the head cap 32 has been in a pressurized state (not in a negative-pressure state) and the pressurized air having the air pressure p has caused the inks BI, CI, MI, and YI to assume convex shapes at the tips of the nozzles 23*a*–23*d*, none of inks of other colors and dust that are stuck to portions around the nozzles 23*a*–23*d* and air enter the nozzles 23*a*–23*d*.

Figure 7D:
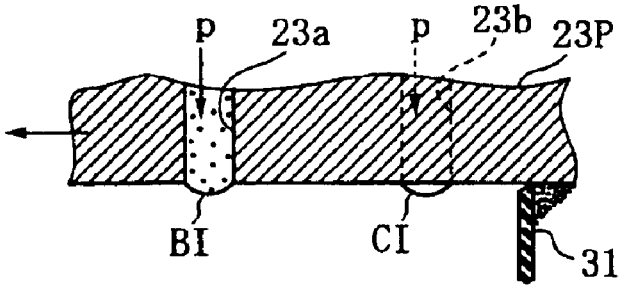

Further, in this state, the print head 23P is moved leftward as shown in FIG. 7D, whereby the printing surface of the print head 23P is wiped over with the wiper blade 31. Finally, the maintenance motor 33 is driven to lower the wiper blade 31. The driving of the pump motor 50 is stopped at the same time as the wiper blade 31 reaches its original standby position. The pressurized air having the air pressure p continues to act on the nozzles 23*a*–23*d* even during the wiping with the wiper blade 31, so that none of wiped-off inks BI, CI, MI, and YI, dust, and air enter the nozzles 23*a*–23*d*.

Figure 7E:
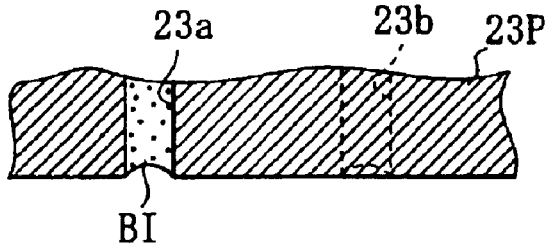

When the pressurized air having the air pressure p that has acted on the nozzles 23*a*–23*d* has been depressurized upon the stop of operation of the air pump 55, a negative pressure due to the above-mentioned head difference H forms, at the tips of the nozzles 23*a*–23*d*, meniscuses suitable for printing that are curved inward as shown in FIG. 7E. After the maintenance processing has completed in the above manner, printing processing is performed on the basis of printing data, to thereby print a color image on a sheet that is supplied from the sheet feeder 2. The maintenance mechanism section 11 corresponds to a maintenance unit.

As described above, in maintenance processing, pressure purge processing using the head caps 32 and wiping processing using the wiper blade 31 are conducted in a state where the pressurized air having the air pressure p produced by the air pump 55 acts on the nozzles 23*a*–23*d*. Therefore, color contamination and loss of a color can be prevented reliably during printing that is performed after pressure purge processing. Further, since an air pressure adjustment of pressurized air to be supplied to the ink cartridges 40–43 is performed by exhausting, through the orifice 61, part of the pressurized air produced by the air pump 55, the air pressure adjustment can be performed easily at the low costs.

Subsequently, modifications of the above embodiment will be described. Components other than modified ones will be given the same reference symbols as used in the embodiment.

1) Instead of the flexible film member that is provided in each of the ink cartridges 40–43 to partition the cartridge case into the ink accommodation chamber and the air chamber, any film member or wall member can be used as long as it can serve as a deformable wall capable of transmitting air pressure acting on the air chamber to the ink in the ink accommodation chamber.

Figure 8:
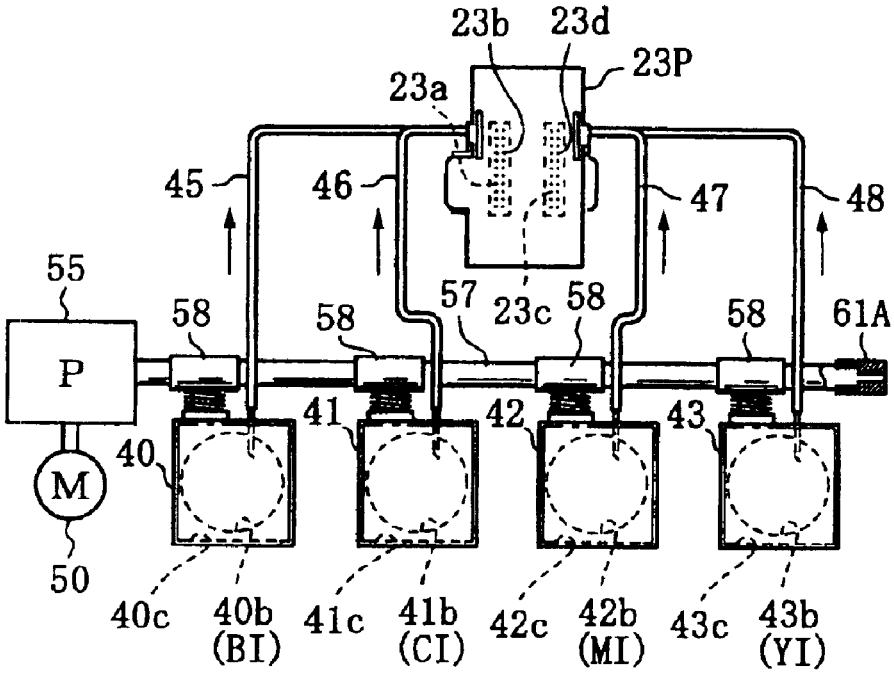
FIG. 8 shows a modified example of the ink supply section and the air supply section shown in FIG. 6.

2) As shown in FIG. 8, an orifice 61A may be provided at the opposite end of the air supply tube 57 to the air pump 55. In this example, a pressure adjustment is performed by the orifice 61A's exhausting part of pressurized air supplied from the air pump 55 and resulting pressure-adjusted pressurized air acts on the air chambers 40*c*–43*c*.

However, in this case, the air pressure acting on the air chamber 40*c*, 41*c*, 42*c*, or 43*c* of the ink cartridge 40, 41, 42, or 43 is higher as the ink cartridge is closer to the air pump 55 though the pressure difference is small. In view of this, the ink viscosities are set in such a manner that black ink BI>cyan ink CI>magenta ink MI>yellow ink YI. The black ink cartridge 40 with the highest ink viscosity is located at the position closest to the source of a flow of pressurized air, that is, at the leftmost position where the air pressure p of pressurized air supplied form the air pump 55 is highest.

The cyan ink cartridge 41 with the second highest ink viscosity is located next to the black ink cartridge 40. The magenta ink cartridge 42 with the third highest ink viscosity is located next to the cyan ink cartridge 41. The yellow ink cartridge 43 with the lowest ink viscosity is located at the rightmost position. As a result, the pressure of the black ink BI acting on the black nozzle 23*a* is made approximately the same as the pressure of the cyan ink CI, magenta ink MI, or yellow ink YI having the lower ink viscosity acting on the dedicated nozzle 23*b*, 23*c*, or 23*d*; the pressure differences of pressurized air can be made uninfluential.

3) The inner diameter of the air supply tube 57 may be decreased gradually as the position goes away from the air pump 55, that is, comes closer to the orifice 61A. The air supply tube 57 that becomes thinner as the position goes away from the air pump 55 makes it possible to decrease the pressure inside the air supply tube 57 gradually. This in turn makes it possible to decrease the size of the orifice 61A that is provided at the opposite end of the air supply tube 57 to the air pump 55. The orifice 61A can even be omitted when the degree of pressure decrease is high.

4) The air pump 55 is not limited to the one using a diaphragm, and may be any of various kinds of small air pumps.

5) The negative pressure acting on the ink accommodation chambers 40*b*–43*b* of the ink cartridges 40–43 need not always be produced by the head difference H that is caused by the difference between the heights of the print head 23P and the ink cartridges 40–43, and may be produced any of various negative pressure generating means by, for example, forcibly expanding the ink accommodation chambers 40*b*–43*b* by means of a certain member.

6) The invention is not limited to or by the above embodiment and modifications. Other various modifications are possible without departing from the spirit and scope of the invention and, as such, the invention can be applied to various ink jet printers.

According to a first aspect of the invention, in an ink jet printer having a print head, an ink cartridge, and an ink supply tube, the ink cartridge comprises an ink accommodation chamber at least part of which is a deformable wall and an air chamber for exerting, via the wall, air pressure on ink accommodated in the ink accommodation chamber. The ink jet printer further comprises an air pump for producing pressurized air for changing a state of ink that is located at a tip portion of each of the ink jet nozzles; an air supply tube for guiding the pressurized air produced by the air pump to the air chamber of the ink cartridge; and a maintenance unit comprising a cap member for covering a head surface of the print head. The maintenance unit opens the cap member in a state that the pressurized air is supplied to the air chamber of the ink cartridge. Therefore, the ink in the ink accommodation chamber, at least part of which is the deformable wall, of the ink cartridge is supplied to each ink jet nozzle via the ink supply tube.

In maintenance processing, the air pump operates and pressurized air produced by the air pump is introduced into the air chamber of the ink cartridge via the air supply tube. Therefore, the ink accommodation chamber of the ink cartridge receives air pressure. As a result, the ink in the ink accommodation chamber is supplied to the print head via the ink supply tube, whereby the state of the ink at the tip of each ink jet nozzle is changed, that is, the ink expands there. A purge can be performed in this state. However, since after the purge the cap member is opened in a state that the pressure in the cap member is not negative, none of other inks that are stuck to portions around ink jet nozzles, dust, and air go into nozzles. This reliably prevents color contamination or loss of a color that might otherwise occur in the subsequent color printing operation.

According to a second aspect of the invention, the maintenance unit further comprises a wiper member for wiping over the head surface of the print head, and the air pump supplies the pressurized air to the air chamber of the ink cartridge from a prescribed time before opening of the cap member to completion of wiping of the head surface with the wiper member. Therefore, the pressure in the cap member is not negative when the cap member is opened and this pressurized state continues also when the head surface is wiped over with the wiper member. Therefore, none of other inks that are stuck to portions around ink jet nozzles, dust, and air go into nozzles. This reliably prevents color contamination or loss of a color that might otherwise occur in the subsequent color printing operation.

According to a third aspect of the invention, the ink cartridge is a plurality of ink cartridges that accommodate inks of plural colors, respectively, and that are connected in parallel to the air supply tube in a horizontal plane. Since the plurality of ink cartridges have the same height and are arranged parallel with each other, the space occupied by the ink cartridges can be made small.

According to a fourth aspect of the invention, an orifice for exhausting part of the pressurized air is provided in the vicinity of an air-pump-side end of the air supply tube. Therefore, part of the pressurized air is exhausted by the orifice that is provided in the vicinity of the air-pump-side end of the air supply tube, whereby a pressure adjustment is made.

According to a fifth aspect of the invention, an orifice for exhausting part of the pressurized air is provided in the vicinity of an opposite end of the air supply tube to the air pump. Therefore, part of the pressurized air is exhausted by the orifice that is provided in the vicinity of the opposite end of the air supply tube to the air pump, whereby a pressure adjustment is made.

According to a sixth aspect of the invention, the plurality of ink cartridges are arranged in such a manner that an ink cartridge with a higher ink viscosity is located upstream of a flow of the pressurized air from the air pump to the orifice. That is, an ink cartridge with a higher ink viscosity is located at a position closer to the source of a flow of the pressurized air, that is, at a position where the air pressure of the pressurized air supplied from the air pump is higher. Therefore, an ink having a higher ink viscosity receives a higher air pressure and hence is jetted in the same manner as an ink having a lower ink viscosity. The pressure differences of the pressurized air acting on the ink jet nozzles can easily be made uninfluential.

According to a seventh aspect of the invention, the inner diameter of the air supply tube decreases as the position goes from the air pump to the orifice. The air supply tube that becomes thinner as the position goes away from the air pump makes it possible to decrease the pressure inside the air supply tube gradually along its length. This in turn makes it possible to decrease the size of the orifice that is provided at the opposite end of the air supply tube to the air pump. The orifice can even be omitted when the degree of pressure decrease is high.

According to an eighth aspect of the invention, the print head is located at a position higher than the ink cartridge by a prescribed length, whereby a negative pressure acts on each of the ink jet nozzles of the print head and a concave ink meniscus is thereby formed at a tip of each of the ink jet nozzles. Because of a head difference that is caused by the difference between the heights of the print head and the ink cartridge, a negative pressure acts on each ink jet nozzle of the print head and a proper concave ink meniscus is thereby formed at the tip of each ink jet nozzle. The printing quality can thus be increased.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet printer, comprising:

a print head having a plurality of ink jet nozzles arranged in plural columns;

an ink cartridge including an ink accommodation chamber having a deformable wall and an air chamber for exerting via the wall air pressure on ink accommodated in the ink accommodation chamber;

an ink supply tube connecting the ink cartridge to the print head;

an air pump for producing pressurized air for changing a state of ink that is located at a tip portion of each of the ink jet nozzles;

an air supply tube for guiding the pressurized air to the air chamber of the ink cartridge; and a maintenance unit including a cap member for covering the print head, wherein the maintenance unit opens the cap member while the air pump supplies the pressurized air to the air chamber of the ink cartridge such that the pressurized air projects the ink in a convex shape from a tip portion of each of the ink jet nozzles.

2. The ink jet printer according to claim 1, wherein the maintenance unit further comprises a wiper member for wiping over the print head, and the air pump supplies the pressurized air to the air chamber of the ink cartridge from a prescribed time before the cap member opens till the wiper member completes wiping.

3. The ink jet printer according to claim 2, wherein the ink cartridge comprises a plurality of ink cartridges that accommodate inks of plural colors, respectively, and are connected in parallel to the air supply tube in a horizontal plane.

4. The ink jet printer according to claim 2, wherein an orifice for exhausting part of the pressurized air is provided in a vicinity of an air-pump-side end of the air supply tube.

5. The ink jet printer according to claim 4, wherein the ink cartridge comprises a plurality of ink cartridges arranged in such a manner that an ink cartridge with a higher ink viscosity is located upstream of a flow of the pressurized air from the air pump to the orifice.

6. The ink jet printer according to claim 4, wherein the ink cartridge comprises a plurality of ink cartridges arranged in such a manner that an ink cartridge with a higher ink viscosity is located upstream of a flow of the pressurized air from the air pump to the orifice.

7. The ink jet printer according to claim 5, wherein an inner diameter of the air supply tube decreases as a position goes from the air pump to the orifice.

8. The ink jet printer according to claim 2, wherein the print head is located at a position higher than the ink cartridge by a prescribed length, whereby, when the air pump is stopped from supplying the pressurized air, a negative pressure acts on each of the ink jet nozzles of the print head and a concave ink meniscus is formed at a tip of each of the ink jet nozzles.

9. The ink printer according to claim 1, wherein the cap member covers a head surface of the print head formed with the ink jet nozzles so as to provide a space between the cap and the head surface, and maintenance unit opens the cap member when the space in the cap is in a pressurized state.

10. An ink jet printer, comprising:

a print head having a plurality of ink jet nozzles arranged in plural columns;

an ink cartridge including an ink accommodation chamber having a deformable wall and an air chamber adjoining to the ink accommodation chamber via the wall, the ink accommodation chamber accommodating ink to be supplied to the print head;

an ink supply tube connecting the ink cartridge to the print head;

an air pump for producing pressurized air for changing a state of ink that is located at a tip portion of each of the ink jet nozzles;

an air supply tube for guiding the pressurized air produced by the air pump to the air chamber of the ink cartridge; and a maintenance unit including a cap member for covering the print head in conducting a maintenance of the print head, wherein the maintenance unit opens the cap member while the air pump supplies the pressurized air to the air chamber of the ink cartridge such that the pressurized air projects the ink in a convex shape from a tip portion of each of the ink jet nozzles.

11. An ink jet printer, comprising:

a print head having a plurality of ink jet nozzles arranged in plural columns;

an ink cartridge accommodating ink to be supplied to the print head;

an ink supply tube connecting the ink cartridge to the print head;

means for covering the print head so as to shut communication of ink that is located at a tip portion of each of the ink jet nozzles with ambient air;

means for producing pressurized air to be supplied to the ink cartridge for changing a state of the ink that is located at a tip portion of each of the ink jet nozzles; and means for opening the print head so as to communicate the ink projecting in a convex shape from a tip portion of each of the ink jet nozzles with the ambient air while the pressurized air is supplied to the ink cartridge.

12. A maintenance method in an ink jet printer, wherein the ink jet printer includes a print head having a plurality of ink jet nozzles arranged in plural columns, an ink cartridge accommodating ink to be supplied to the print head, and an ink supply tube connecting the ink cartridge to the print head, the maintenance method comprising:

covering the print head so as to shut communication of ink that is located at a tip portion of each of the ink jet nozzles with ambient air;

producing pressurized air to be supplied to the ink cartridge for changing a state of the ink that is located at a tip portion of each of the ink jet nozzles; and opening the print head so as to communicate the ink projecting in a convex shape from a tip portion of each of the ink jet nozzles with the ambient air while the pressurized air is supplied to the ink cartridge.

* * * * *

UNITED STATES PATENT AND TRADEMARK OFFICE

CERTIFICATE OF CORRECTION

PATENT NO. : 6,991,313 B2
DATED : January 31, 2006
INVENTOR(S) : Masahiko Sasa

It is certified that error appears in the above-identified patent and that said Letters Patent is hereby corrected as shown below:

Title page,

Item [56], References Cited, U.S. PATENT DOCUMENTS, should read as follows:

| | | | | | |
|---|---|---|---|---|---|
| -- 4,510,510A | | | 4/1985 | Terasawa | |
| 4,558,326 A | * | | 12/1985 | Kimura et al. | 347/30 |
| 5,557,306 A | * | | 9/1996 | Fukushima et al. | 347/33 |
| 6,145,802 | | | 11/2000 | Nakagaki et al. | 248/638 --. |

FOREIGN PATENT DOCUMENTS, should read as follows:

| | | | |
|---|---|---|---|
| -- CN | 1136501 A | | 11/1996 |
| JP | 404070355 A | * | 3/1992 |
| JP | 404080037 A | * | 3/1992 |
| JP | B2 2703647 | | 10/1997 |
| JP | A 10-138506 | | 5/1998 |
| JP | A 2000-065127 | | 3/2000 |
| JP | A 10-305594 | | 11/1998 |
| JP | A 10-114085 | | 5/1998 |
| JP | A 03-099857 | | 4/1991 --. |

Column 11,

Line 10, claim 5 should read as follows:

5. The ink jet printer according to claim 2, wherein an orifice for exhausting part of the pressurized air is provided in a vicinity of an opposite end of the air supply tube to the air pump.

Signed and Sealed this

Eighteenth Day of April, 2006

JON W. DUDAS
*Director of the United States Patent and Trademark Office*